US006640383B2

(12) United States Patent
Tsen

(10) Patent No.: US 6,640,383 B2
(45) Date of Patent: Nov. 4, 2003

(54) STEAM/VACUUM CLEANING APPARATUS

(76) Inventor: Samson Tsen, No. 8, Lane 249, Lung-Chiang Rd., Taipei (TW)

( * ) Notice: Subject to any disclaimer, the term of this patent is extended or adjusted under 35 U.S.C. 154(b) by 22 days.

(21) Appl. No.: 10/012,928

(22) Filed: Dec. 10, 2001

(65) Prior Publication Data

US 2003/0106180 A1 Jun. 12, 2003

(51) Int. Cl.[7] ..... A47L 9/02
(52) U.S. Cl. ..... 15/321; 15/321; 15/322
(58) Field of Search ..... 15/320, 321, 353, 15/322; 68/222; 392/404, 403

(56) References Cited

U.S. PATENT DOCUMENTS 3,439,374 A * 4/1969 Wisdom ..... 15/321
3,896,521 A * 7/1975 Parise ..... 15/321
4,083,077 A * 4/1978 Knight et al. ..... 15/321
4,327,459 A * 5/1982 Gilbert ..... 15/321
4,397,057 A * 8/1983 Harbeck ..... 15/321
5,341,541 A * 8/1994 Sham ..... 15/320

* cited by examiner

*Primary Examiner*—Theresa T. Snider
(74) *Attorney, Agent, or Firm*—Ladas & Parry

(57) ABSTRACT

A steam/vacuum cleaning apparatus has a head case housing with a hollow space and a steam outlet seal sleeve projecting out of the head case housing. An electrical steam generator within the hollow space has an electrical heater, a boiler for generating steam from water in the boiler directed to the steam outlet seal sleeve. An electrical drafting fan assembly within the hollow space creates a negative pressure with a drafting fan, an electrical motor for driving the drafting fan, an air intake port and air exhaust port for creating an air flow path with a suction section and a discharge section. The suction section is upstream of the drafting fan and the discharge section is downstream of the air exhaust port. An air/water separating device in the air flow path is upstream of the suction section for separating and collecting water condensed from air sucked therethrough by the negative pressure. An external connecting member has a first male connector for connecting to the steam outlet seal sleeve of the electrical steam generator and the air/water separating device.

7 Claims, 9 Drawing Sheets

STEAM/VACUUM CLEANING APPARATUS

BACKGROUND OF THE INVENTION

1. Field of the Invention

The present invention relates to a vacuum cleaner, particularly to a steam/vacuum cleaning apparatus that can blast high-pressure steam onto a surface to be cleaned and is equipped with an air/water separating device.

2. Description of Related Art

A vacuum cleaner is conventionally equipped with an electrically drafting fan to create a negative pressure for sucking and collecting dust, hair, small and light particulates or the like resting on a surface of an object to be cleaned, such as floor, carpet, furniture and so forth. In addition, a conventionally wet-type vacuum cleaner is provided not only for collecting small and light particulates, but also for removing water and wet dirt. It is however known that neither a dry-type nor a wet-type vacuum cleaner can function effectively and efficiently for cleaning, if dirt or smear sticks on the surface to be cleaned or the dirt itself is viscous and tacky.

SUMMARY OF THE INVENTION

Accordingly, an object of the present invention is to provide a steam/vacuum cleaning apparatus that can inject a blast of high-pressure steam directly onto a surface to be cleaned to assist removing and cleaning the grime, sticky smear and dirt attaching on the surface to be cleaned, and can readily suck away and collect the dirt detached from the surface to be cleaned and moisture/condensed water caused by the injection of the steam. The steam/vacuum cleaning apparatus in accordance with the present invention comprises a head case assembly, an air/water separating device and at least one external connecting member; wherein the head case assembly includes a housing, an electrical steam generator and an electrical drafting fan assembly both contained in the housing. The fan assembly has a suction section and a discharge section. The air/water separating device is arranged upstream of the suction section of the fan assembly for inducing air flow and collecting condensed water. The external connecting member includes a male connector having a steam connecting port and an air suction port respectively in fluid communication with the steam generator and the suction section of the air/water separating device.

Additional objects, advantages, construction, and features of the present invention will become apparent from the following description and the appended claims, taken in conjunction with the accompanying drawings.

BRIEF DESCRIPTION OF THE DRAWINGS

FIG. 7 is another perspective view of the present invention, showing that the steam/vacuum cleaning apparatus of the present invention can optionally associate with versatile and various external connecting members, such as a steam-air hose set assembly, a steam-air window cleaner assembly, a steam-air brush assembly, a steam-air broom assembly, a steam ejector, a steam iron and the like.

PREFERRED EMBODIMENT OF THE PRESENT INVENTION

Figure 1:
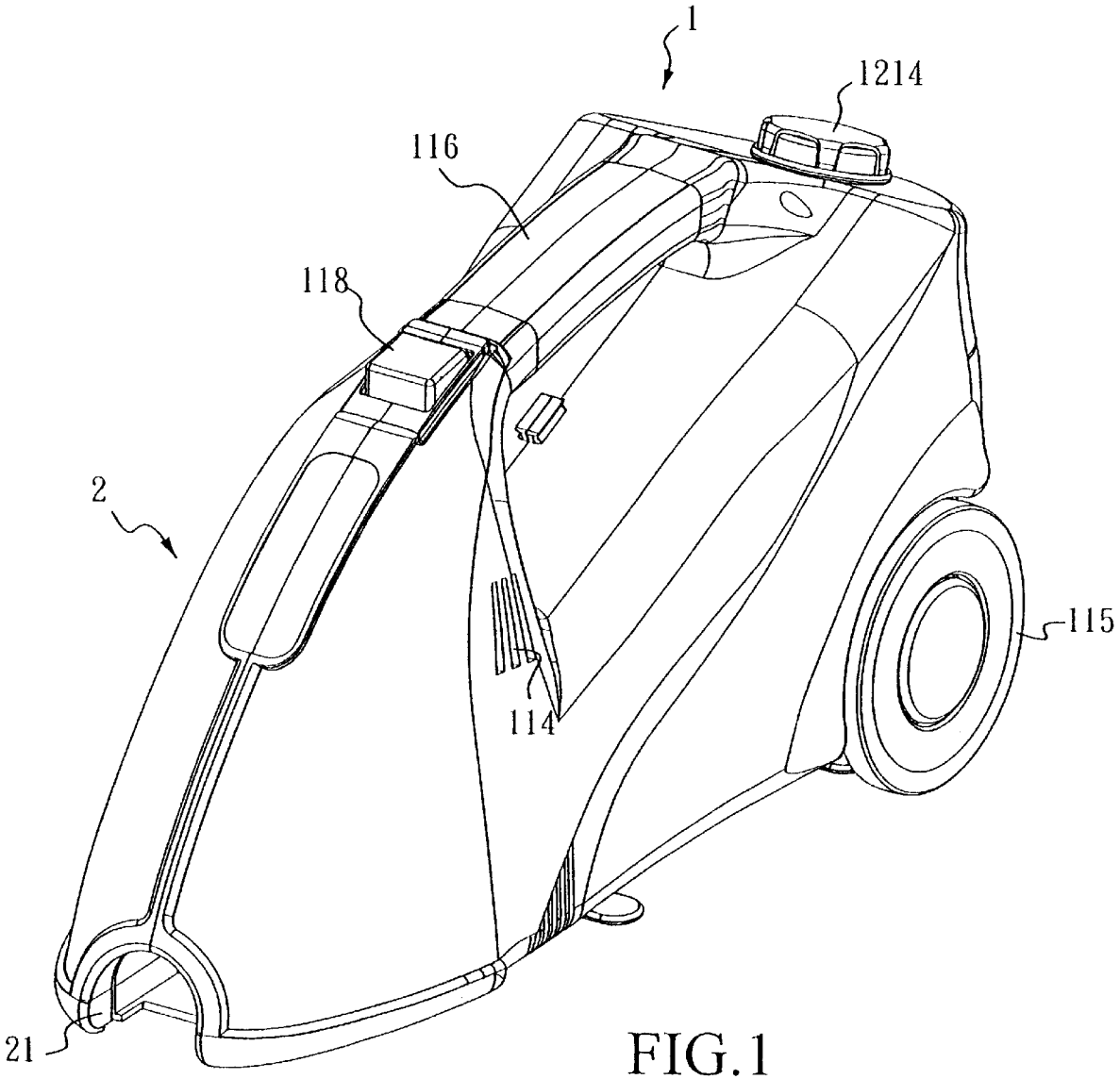
FIG. 1 is a perspective view of the steam/vacuum cleaning apparatus in accordance with the preferred embodiment of the present invention, in which the external connecting member is detached from the steam/vacuum cleaning apparatus.
Figure 2:
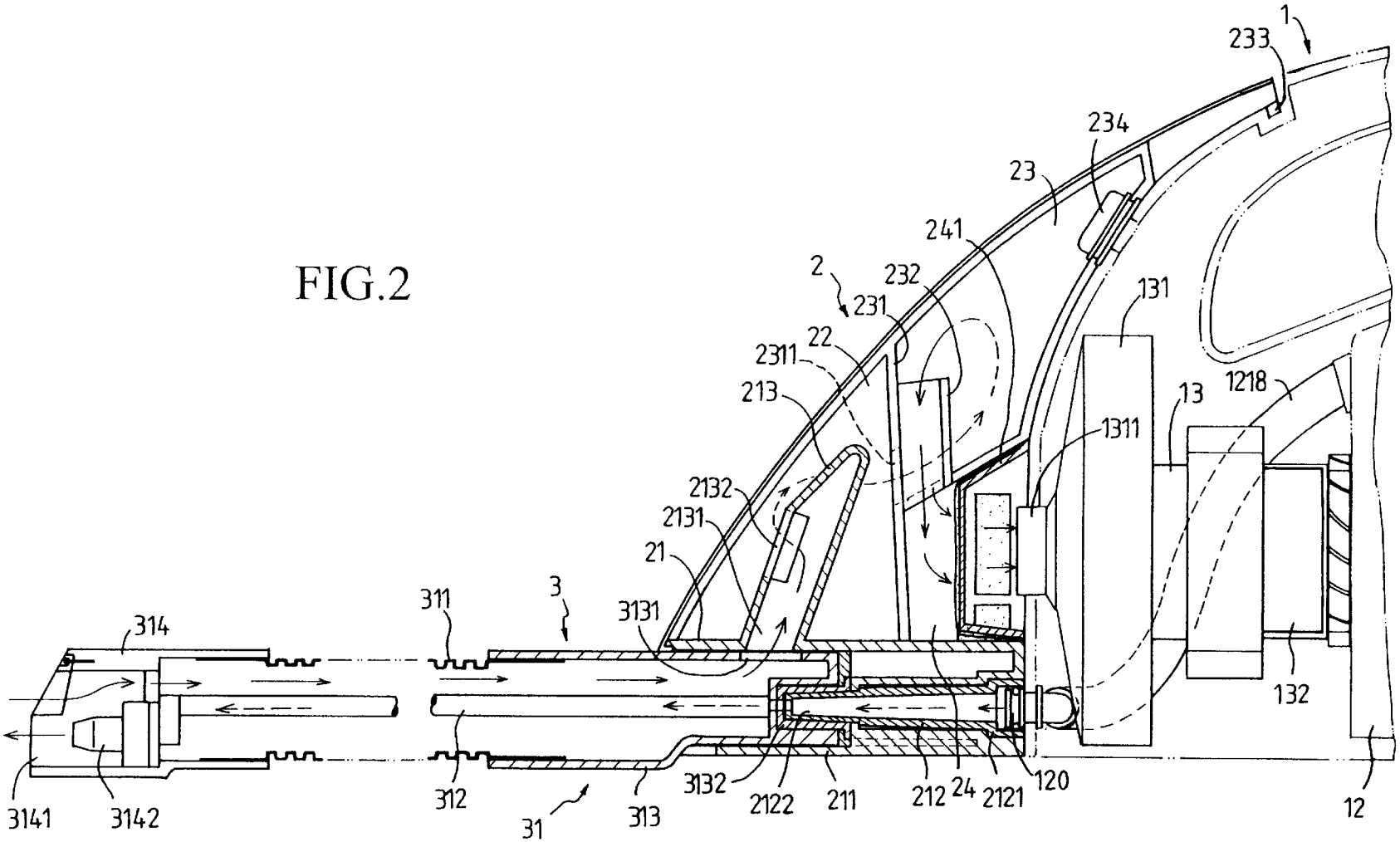
FIG. 2 is a fragmentally and schematically sectional view showing the construction and operation of the steam/vacuum cleaning apparatus in accordance with the preferred embodiment of the present invention, and especially illustrating the operation relationship of the flow of the air and the steam.
Figure 3:
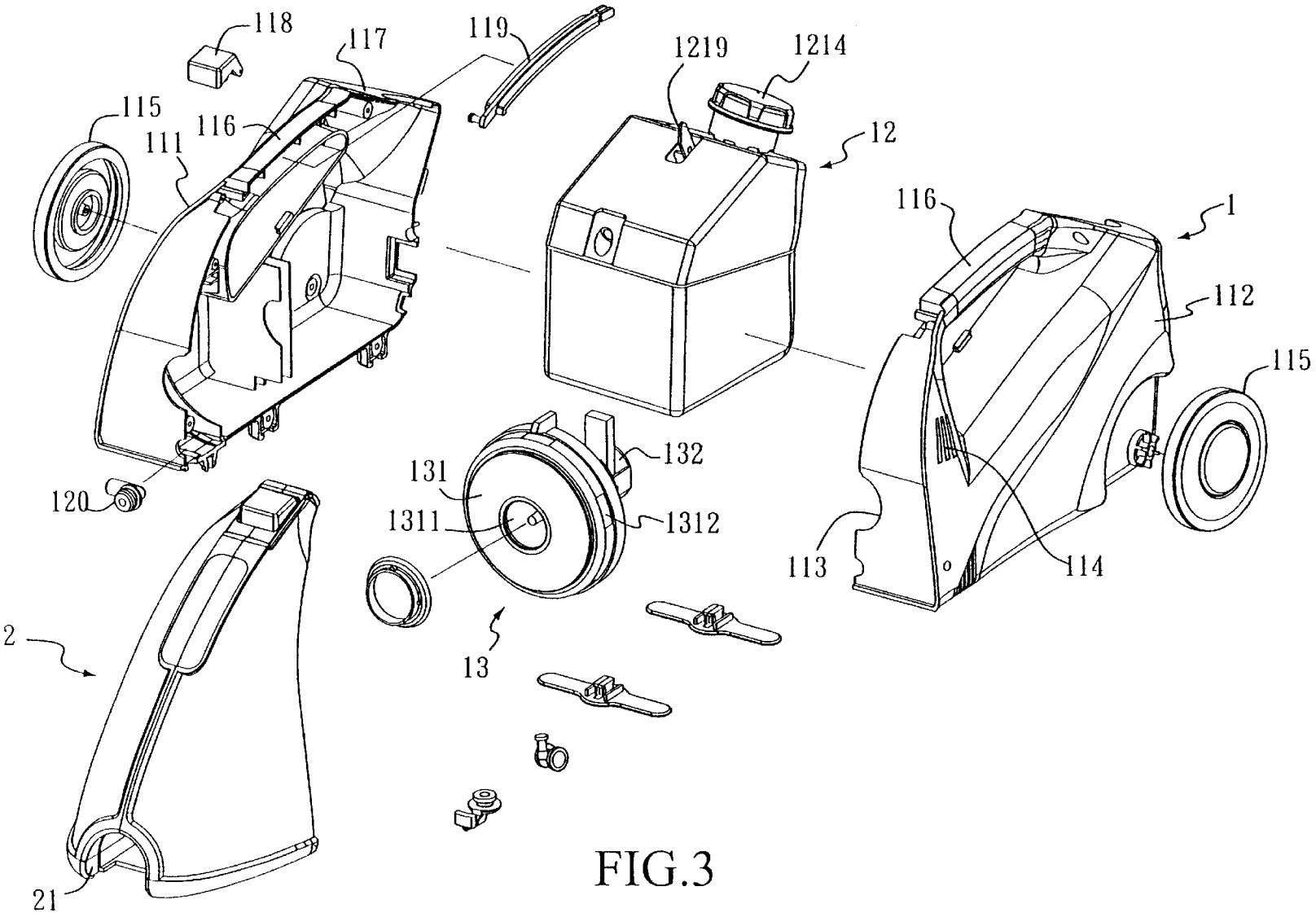
FIG. 3 is an exploded view of the steam/vacuum cleaning apparatus illustrated in FIG. 1, in which the external connecting member is not shown.

As best illustrated in FIGS. 1, 2 and 3, the steam/vacuum cleaning apparatus in accordance with the preferred embodiment of the present invention comprises: a head case assembly 1, an air/water separating device 2 and at least one external connecting member 3; wherein the head case assembly 1 includes a housing 11, an electrical steam generator 12 and an electrical drafting fan assembly 13 both contained in the housing 11.

Referring to FIGS. 1 and 3, the housing 11 is comprised of a left half 111 and a right half 112 substantially symmetrical to each other, and forming therein a hollow space for containing the electrical steam generator 12 and the electrical drafting fan 13. The housing 11 is formed with an intake aperture 113 at a front end thereof and a plurality of venting apertures 114 nearby the front end thereof. Two wheels 115 are pivotally disposed at a rear end of the housing 11. A through hole 117 is formed at the upper portion of the rear end of the housing 11.

Figure 4:
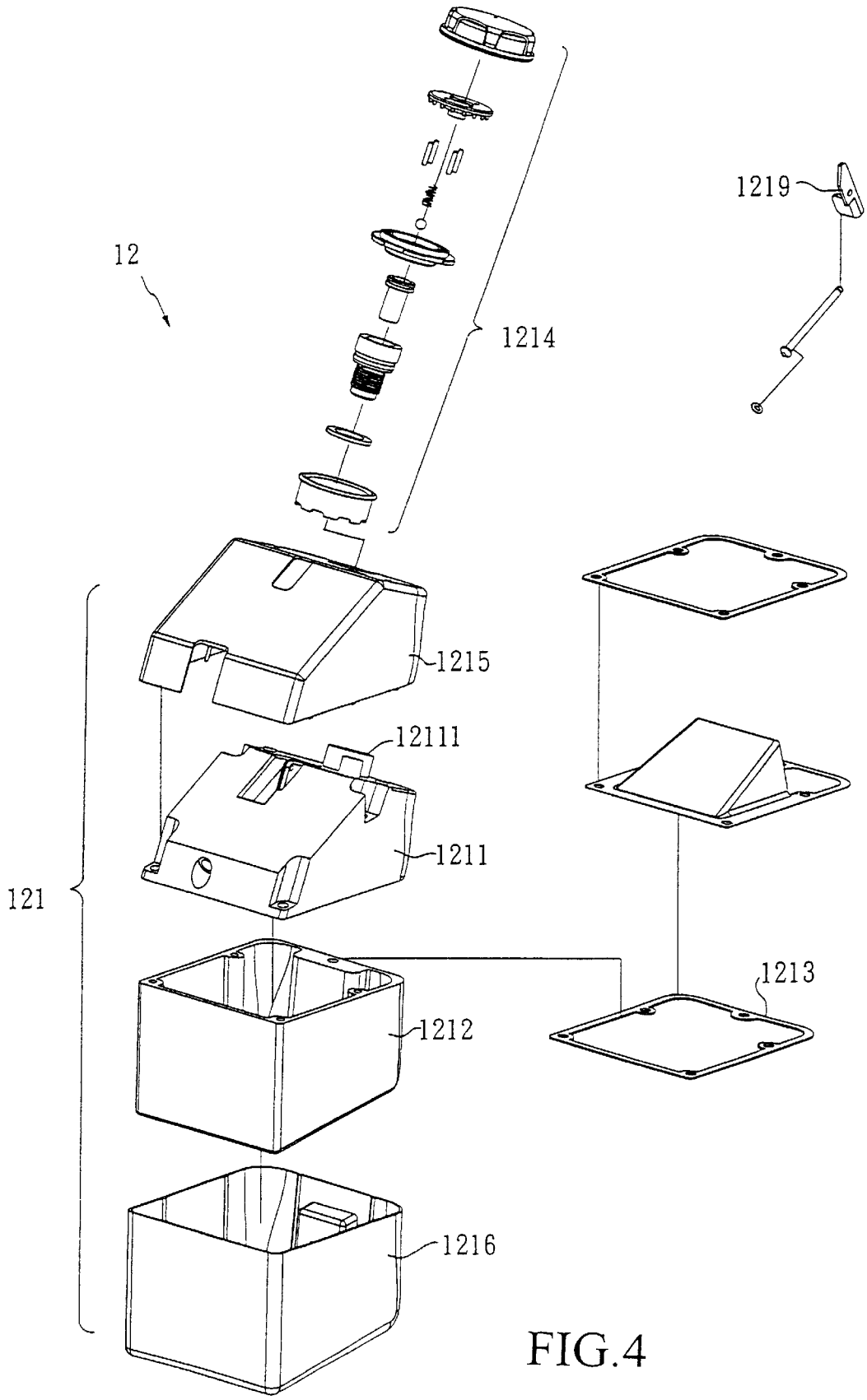
FIG. 4 is an exploded view of the electrical steam generator of the present invention.

Referring to FIGS. 3 and 4, the electrical steam generator 12 mainly comprises a boiler 121 and electrical heater (not shown); wherein the boiler 121 is a pressure vessel comprised of an upper tank 1211 and a lower tank 1212. The upper tank 1211 and the lower tank 1212 are preferably made from cast aluminum having a sealing gasket 1213 interposed therebetween and assembled by a plurality of bolts (not shown). The upper tank 1211 is formed at its upper part with a water refilling inlet 12111 which can be sealed by a screw-tightenable water refilling enclosure assembly 1214. The enclosure assembly 1214 extends out of the aperture 117 of the housing 11 (see FIG. 5A). The electrical heater (not shown) is disposed at the bottom of the boiler 121 for heating water contained within the boiler 121 and generating high-pressure and high-temperature steam. The electrical heater is independently powered by a separate switch (not shown). The upper tank 1211 and the lower tank 1212 are preferably circumferentially wrapped with an upper shield 1215 and a lower shield 1216 made from thermal-insulant.

Figure 5A:
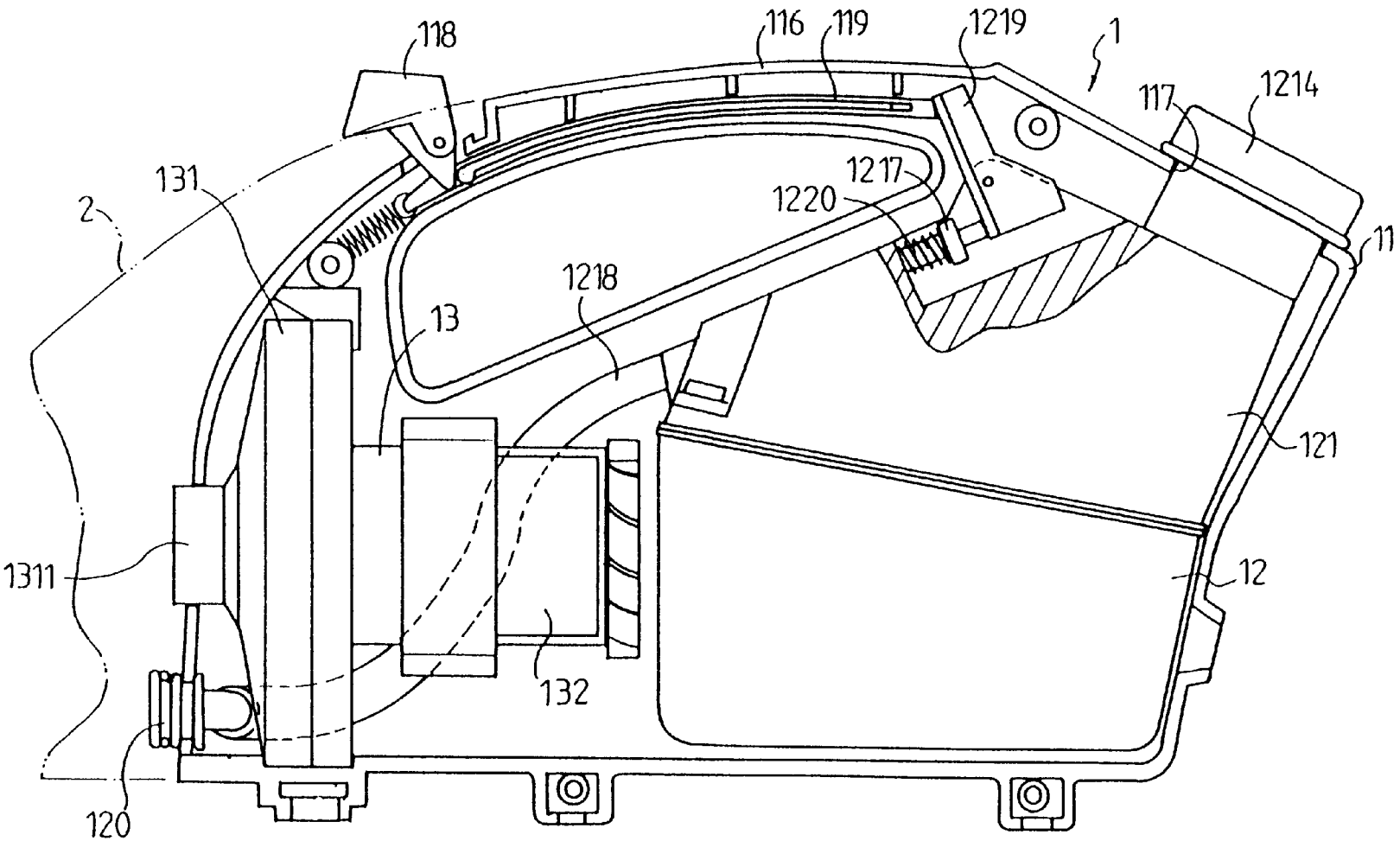
FIG. 5A is a fragmentally sectional view of the present invention, showing that the steam generated by the electrical steam generator is controlled by a normally closed valve and not transmitted out of the boiler.
Figure 5B:
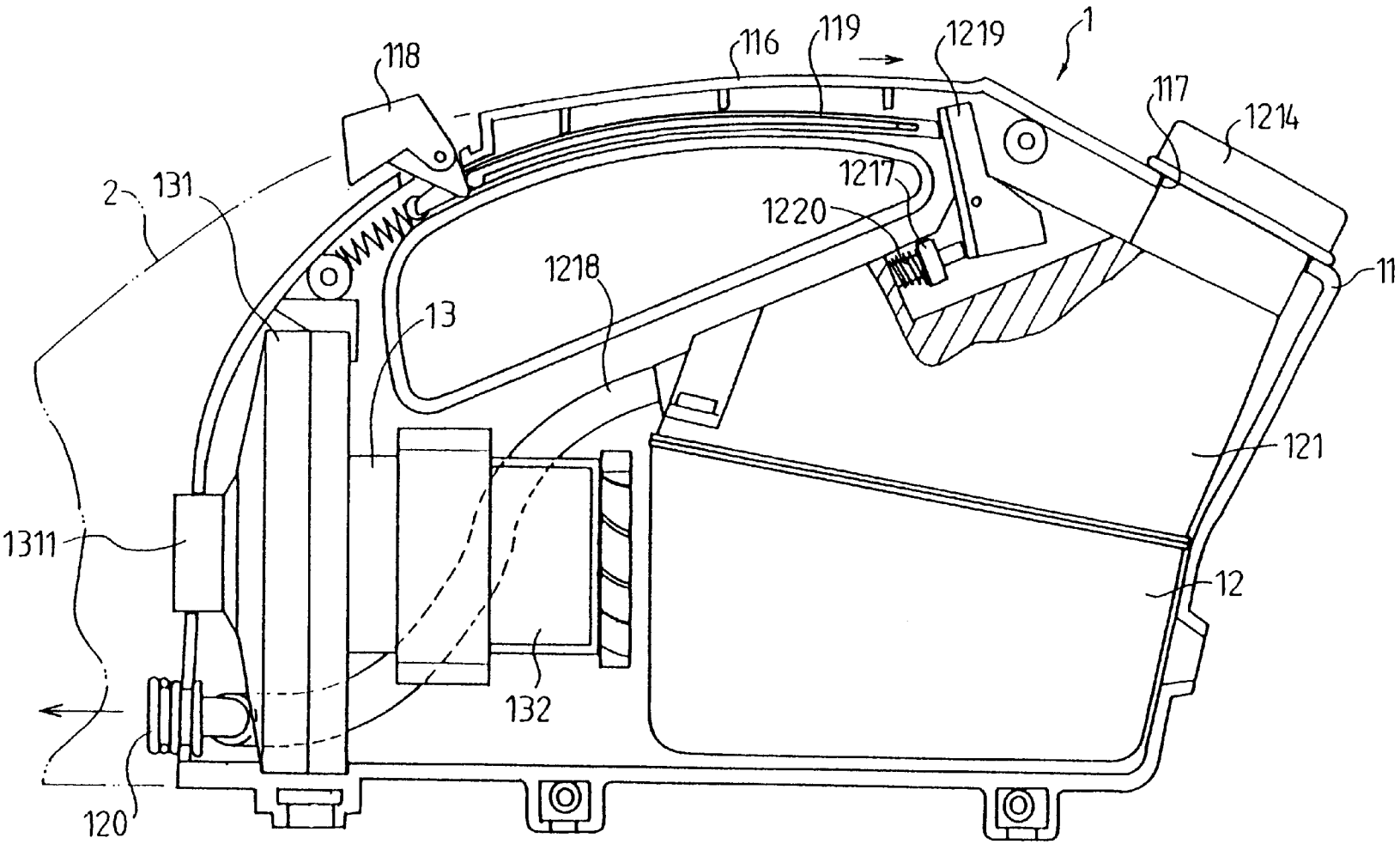
FIG. 5B is another fragmentally sectional view of the present invention, showing that the steam generated by the electrical steam generator is controlled by a normally closed valve and transmitted out of the boiler.

As can be seen in FIGS. 4, 5A and 5B, the boiler 121 is provided with a steam control valve 1217 at its top for controlling the flow of the steam generated by the boiler 121 to a steam tube 1218. The steam control valve 1217 is operated by a push button 118 pivotally disposed on the housing 11 in association with a push rod 119 slidably disposed within a hollow handle 116 and a lever 1219 pivotally disposed on the housing 11, to control the valve opening of the steam control valve 1217. The steam control valve 1217 is resiliently biased and normally maintained in a normal-closed condition by a compression spring 1220. The steam tube 1218 has two ends, one connecting to the steam control valve 1217, and the other connecting to a steam outlet seal sleeve 120 projecting out of the front end of the housing 11.

Referring to FIGS. 2, 3 and 5A, the electrical drafting fan assembly 13 comprises a drafting fan 131 and an electric motor 132, in which the drafting fan 131, in the illustrated embodiment, is an radial induce fan having a central intake port 1311 located corresponding to the intake aperture 113 of the housing 11. The radial circumference of the drafting fan 131 is formed with a plurality of exhaust ports 1312 corresponding to the venting apertures 114 of the housing 11. The electric motor 132 co-axially engages and drives the drafting fan 131, and independently powered by a separate switch (not shown).

As illustrated in FIG. 2, the air flow path upstream of the drafting fan 131 and located before the intake port 1311 is defined as a suction section, and the air flow path downstream of the drafting fan 131 and located after the exhaust ports 1312 is defined as a discharge section.

Figure 6:
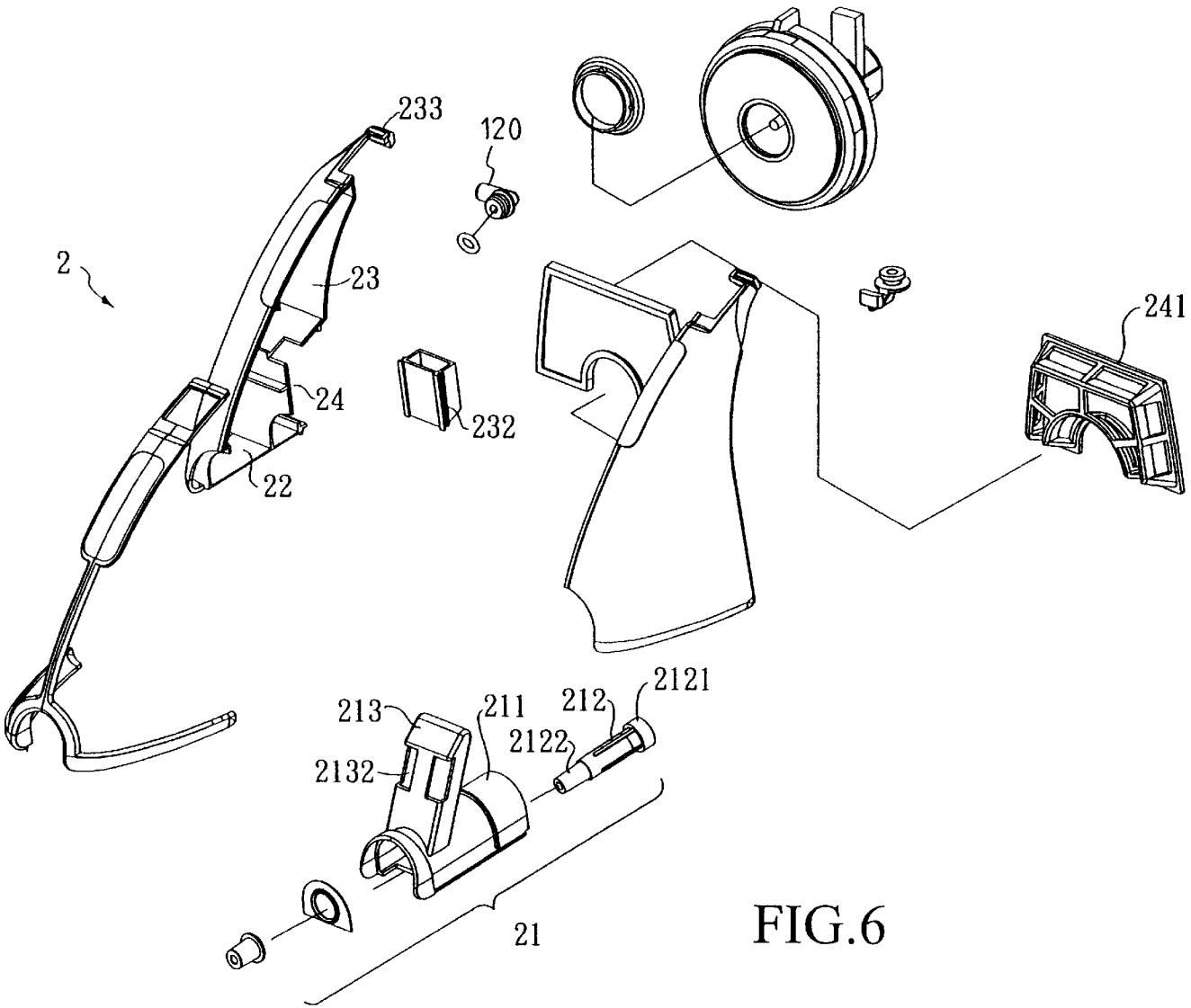
FIG. 6 is an exploded view of the air/water separating device of the present invention.

Referring to FIGS. 2, 3 and 6, the air/water separating device 2 comprises a U-channel connector 21, a first cyclone chamber 22, a second cyclone chamber 23 and a receiving chamber 24. The U-channel connector 21 includes a mainbody 211, a steam nozzle insert 212, and an air intake duct 213. The mainbody 211 is located at a place corresponding to the steam outlet seal sleeve 120 disposed on the housing 11. The steam nozzle insert 212 has a first end 2121 and a second end 2122, in which the first end 2121 extends out of the mainbody 211 for detachably and sealingly engaging the seal sleeve 120. The second end 2122 is tapered and extending along the mainbody 211. The air intake duct 213 laterally extends from the mainbody 211 into the first cyclone chamber 22. A suction opening 2131 is formed at the intersection of the air intake duct 213 and the mainbody 211. The air intake duct 213 has a free end formed with discharge openings 2132 for inducing and directing wet air to blow against an inner wall of the first cyclone chamber 22 to facilitate the condensation of the moisture of the induced wet air, and to separate suspending water droplets from the induced air by virtue of centrifugal effect caused by high-speed swirling of the air flow in the first cyclone chamber 22.

The second cyclone chamber 23 is located downstream of the first cyclone chamber 22 in the suction section, and separated from the first cyclone chamber 22 by a partition 231. The partition 231 is formed with two through holes 2311 in fluid communication between the first and the second cyclone chambers 22 and 23. The second cyclone chamber 23 is further provided with a rectangular conduit 232 for directing airflow from the second cyclone chamber 23 to the receiving chamber 24. Before passing through the rectangular conduit 231, the airflow in the second cyclone chamber 23 changes flowing direction and creates swirling to further separate and collect the condensed water droplets suspending in the airflow. The receiving chamber 24 is located downstream of the second cyclone chamber 23 in the suction section for sealingly abutting against the housing 11 and sealingly engaging the air intake port 1311 of the fan assembly 13. When the electrical drafting fan assembly 13 is powered, air can be sucked and induced from the suction opening 2131 and passing through the discharge openings 2132, the through holes 2311, the rectangular conduit 232 and the air intake port 1311, so that the sucked air sequentially passes through the first cyclone chamber 22, the second cyclone chamber 23 and the receiving chamber 24 to the electrical drafting fan assembly 13. A duct filter 241 is disposed within the receiving chamber 24 for filtering suspending dust carried by the sucked air.

The second cyclone chamber 23 is further formed with a water discharge port 234 for discharging and removing water collected in the air/water separating device 2. The air/water separating device 2 is provided at its upper part with an engaging hook 233, and at its lower part with a re-closeable fastener (not shown), for detachably engaging the air/water separating device 2 with the front end of the housing 11 (see FIGS. 1 and 2).

Figure 7:
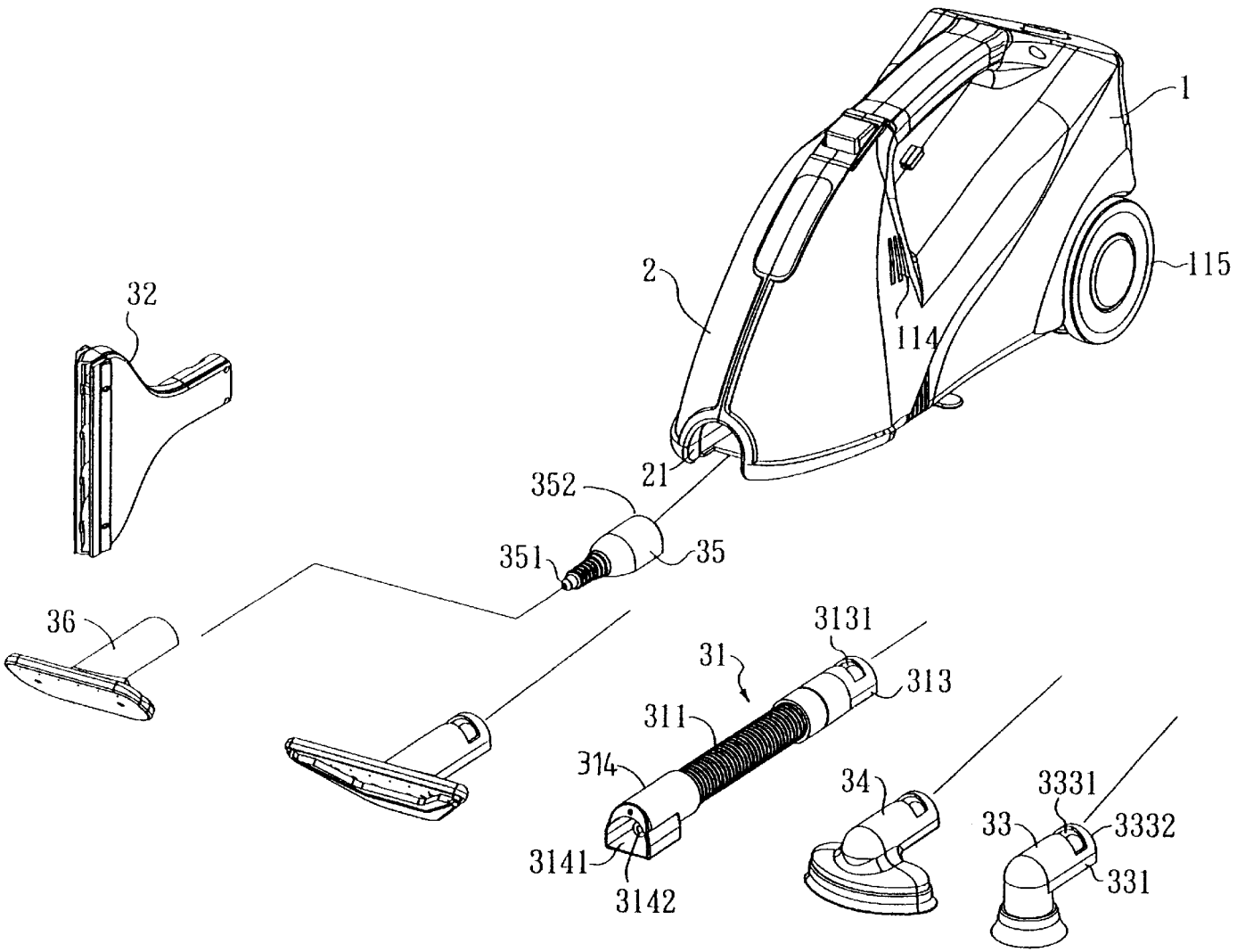

Referring to FIGS. 2 and 7, the external connecting member 3, according to the specific function and purpose to be required, may have various construction, such as a steam-air hose set assembly 31, a steam-air window cleaner assembly 32, a steam-air brush assembly 33, a steam-air broom assembly 34, a steam injecting element 35, a steam iron assembly 36 and the like.

As illustrated in FIGS. 2 and 7, the steam-air hose set assembly 31 comprises an outer duct 311, an inner duct 312, a U-channel male connector 313, and a U-channel female connector 314. The outer duct 311 and the inner duct 312 are all flexible hoses extending co-axially. The U-channel male connector 313 is disposed on one end of the inner and outer ducts 311 and 312 and designed to be slightly tightly received within the U-channel connector 21 of the air/water separating device 2. The male connector 313 is formed with an air suction port 3131 corresponding to the suction opening 2131 of the air/water separating device 2 to allow the outer duct 311 to be in fluid communication with the first cyclone chamber 22. The male connector 313 is further provided with a steam connector 3132 corresponding to the second end 2122 of the steam nozzle insert 212 and connecting to a terminal end of the inner duct 312, for sealingly connecting the second end 2122 of the steam nozzle insert 212 and directing steam toward the inner duct 312.

The U-channel female connector 314 is formed with an open connecting head 3141 for slightly tightly receiving the male connector 313 and in fluid communication with the outer duct 311. The female connector 314 is provided therein a tapered steam connecting head 3142 for engaging the steam connector 3132 of the male connector 313.

Figure 8:
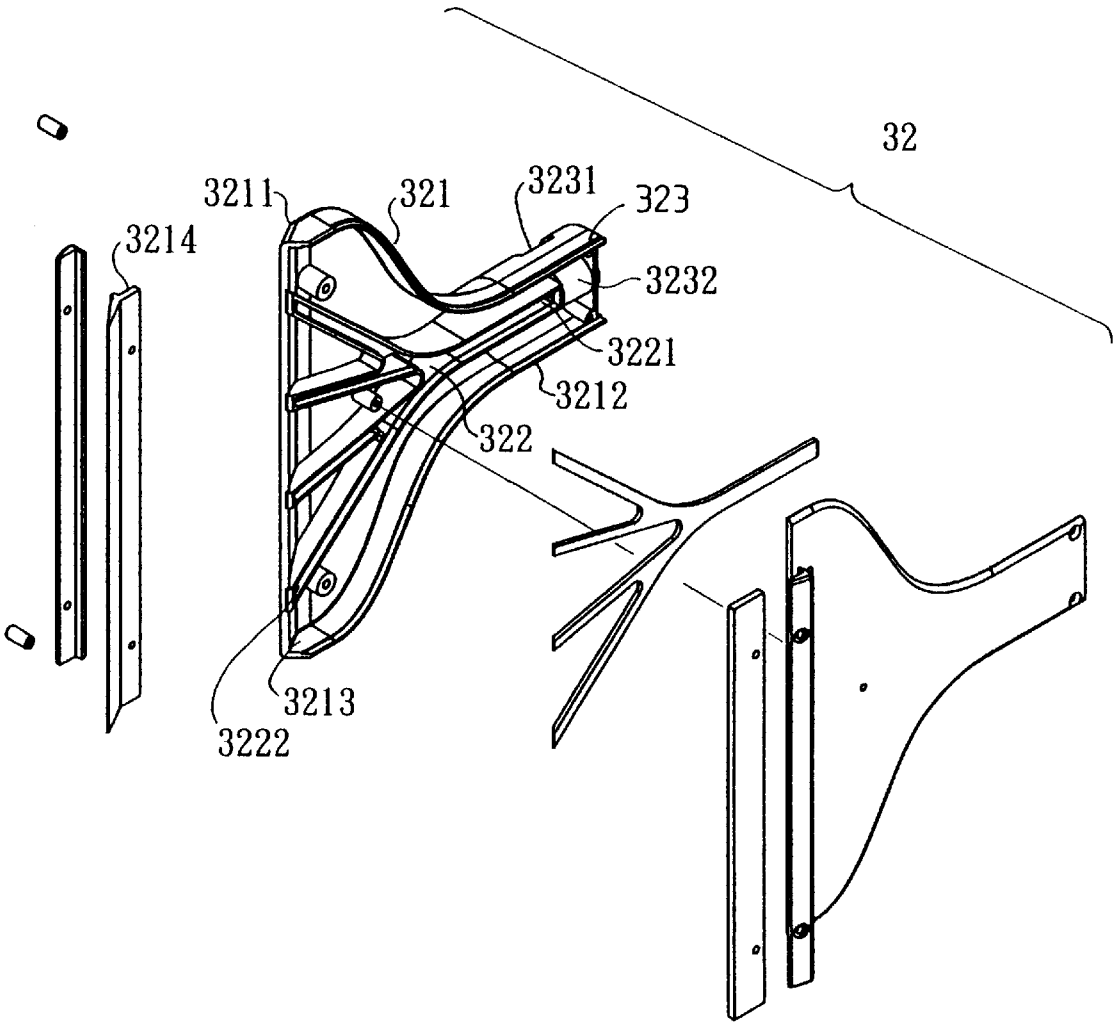
FIG. 8 is an exploded view showing the construction of one of the external connecting members, the steam-air window cleaner assembly, of the present invention.

The external connecting member of the present invention can also be in a form of the steam-air window cleaner assembly 32 illustrated in FIGS. 7 and 8. The steam-air window cleaner assembly 32 comprises a hollow cleaner body 321 and an inner duct 322, in which the hollow cleaner body 321 includes a big end 3211 and a small end 3212, and formed therein a hollow space to serve as an outer duct for directing air passing therethrough. The small end 3212 is formed as a male connector 323 similar to the male connector 313 as illustrated in FIGS. 2, 7 and described above, so as to be received within the U-channel connector 21 or received within the U-channel female connector 314 of the steam-air hose set assembly 31 illustrated in FIG. 7. The male connector 323 is formed with a suction opening 3231 to be in fluid communication with the first cyclone chamber 22 or the outer duct 311 of the steam-air hose set assembly 31. The big end 3211 of the cleaner body 321 is formed with an elongate slit 3213 in fluid communication with the interior of the hollow cleaner body 321, allowing ambient air to be sucked and passing therethrough to the suction opening 3231. The elongate slit 3213 is provided at its one elongate edge a rubber scraper blade 3214 for wiping and scraping a flat and smooth surface of an object such as a window glass panel. The inner duct 322 is disposed within the hollow cleaner body 321, comprising a steam inlet 3221 and a plurality of steam outlets 3222. The steam inlet 3221 engages the steam connector 3232 of the male connector 323. The steam outlets 3222 are uniformly arranged along the elongate slit 3213 for spraying steam onto a window glass panel to assist the wiping and scrapping operation of the rubber scraper blade 3214 on the window glass panel. The wiped dirt and/or condensed water on the glass panel can be sucked away through the elongate slit 3213, the outer duct, and the suction opening 3231 to the air/water separating device 2. Therefore, the steam/vacuum cleaning apparatus of the present invention can be applied to continuously and rapidly wipe and clean a large dimension surface of a flat and smooth object, such as the glass panel of a curtain wall of a building.

Similarly, the external connecting member of the present invention can also be in a form of the steam-air brush assembly 33 illustrated in FIG. 7. The steam-air brush assembly 33 comprises a male connector 3334 for engaging the U-channel connector 21 of the air/water separating device 2 or the female connector 314 of the steam-air hose set assembly 31 illustrated in FIG. 7. The male connector 3331 is formed with a suction opening 3331 and a steam connector 3332. The suction opening 3331 is adapted to connect the female connector 314 of the steam-air hose assembly 31 or the U-channel connector 21 of the air/water separating device 2. The steam connector 3332 is adapted to engage a steam inner duct (not shown) within the steam-air hose set assembly 31 for directing steam to a big end of the steam-air brush assembly 33. The big end of the steam-air brush assembly 33 is provided with a brush bristles for brushing dirt attaching on an object to be cleaned.

The external connecting member of the present invention can also be in a form of the steam injecting element 35 illustrated in FIG. 7. The steam injecting element 35 has two ends, in which one end is formed as a nozzle 351, and the other end being formed as a male connector 352 adapted to engage the U-channel connector 21 or the female connector 314 of the steam-air hose set assembly 31. The male connector 352 is formed with a steam connector (not shown) for connecting to an inner steam duct (also not shown) in fluid communication with the nozzle 351, so as to direct steam to the nozzle 351 and injecting an intensive blast of steam from the nozzle 351 onto a surface to be cleaned; thereby viscous and sticky dirt, such as oily and tacky smear, can be effectively and readily removed.

Since the electrical steam generator 12 and the electrical drafting fan assembly 13 are independently powered by two separate switches (not shown), a user of the steam/vacuum cleaning apparatus of the present invention can apply the dust-suction function and the steam-spraying function singularly or combiningly, as desired.

When energizing the electrical drafting fan assembly 13 singularly to operate the dust-suction function, the steam/vacuum cleaning apparatus of the present invention is similar to a conventional vacuum cleaner. When energizing the electrical steam generator 12 singularly to operate the steam-spraying function, one may compress the steam injection push button 118 (see FIGS. 2, 5A and 5B) to associate with the push rod 119 and the lever 1219 to control the valve opening of the steam control valve 1217, so that high-pressure steam generated by the steam generator 12 is directed the surface to be cleaned, through the steam tube 1218, steam nozzle insert 212, and the external connecting member, such as the steam-air hose set assembly 31, the steam-air window cleaner assembly 32, the steam-air brush assembly 33, the steam-air broom assembly 34, the steam injecting element 35 and the steam iron assembly 36 illustrated in FIG. 7.

When energizing the electrical steam generator 12 and the electrical drafting fan assembly 13 combiningly, the steam injected to the surface to be cleaned, the condensed water of the injected steam, the dirt detached from the surface to be cleaned by the steam and the moisture created by the injected steam are all sucked and induced to the air/water separating device 2, so that the steam can be effectively and readily applied for cleaning the surface of an object and then be removed, and so that the operation of applying steam for cleaning an object will not humidify an indoor space.

Due to the provision of the air/water separating device 2, most of the water and moisture of the steam and the moisturized air before entering the drafting fan 131 (see FIG. 2) has been removed, so as to minimize the possibility that dust accumulated and collected on the dust filter 241 mixes with condensed water and clogs the dust filter 241.

The above-described embodiment of the present invention is intended to be illustrated only. Numerous alternative embodiments may be devised by those skilled in the art without departing from the scope of the following claims.

What is claimed is:

1. A steam/vacuum cleaning apparatus, comprising:

a head case housing with a hollow space therein and a steam outlet seal sleeve projecting out of the head case housing;

an electrical steam generator within the hollow space and comprising an electrical heater in a boiler is provided for generating steam from water in the boiler, the steam being directed to the steam outlet seal sleeve an electrical drafting fan assembly within the hollow space for creating a negative pressure and having a drafting fans, an electrical motor for driving the drafting fan, an air intake port and air exhaust port for creating an air flow path having a suction section and a discharge section, the suction section being upstream of the drafting fan and the discharge section being downstream of the air exhaust port;

an air/water separating device in the air flow path upstream of the suction section for separating and collecting water condensed from air sucked therethrough by the negative pressure created by the electrical drafting fan assembly; and an external connecting member comprising a first male connector for connecting to the steam outlet seal sleeve of the electrical steam generator and the air/water separating device.

2. The steam/vacuum cleaning apparatus of claim 1, wherein the air/water separating device comprises a U-channel connector, a first cyclone chamber, a second cyclone chamber and a receiving chamber; in which the U-channel connector includes a U-channel connector body, a steam nozzle insert detachably engaging the steam outlet seal sleeve of the head case assembly, and an air intake duct; the air intake duct extending from the U-channel connector body into the first cyclone chamber and in fluid communication therewith for creating a swirl to the air induced into the first cyclone chamber and separating condensed water suspending in the induced air by centrifugal effect; the U-channel connector adapted to connect the external connecting member to allow the steam nozzle insert and the air intake duct thereof to engage the first steam connector and the first suction hole of the external connecting member; the second cyclone chamber located in the suction section downstream of the first cyclone chamber and in fluid communication with the first cyclone chamber, for changing the flowing direction of the air induced therein; the receiving chamber is provided in the suction section downstream of the second cyclone chamber and in fluid communication with the second cyclone chamber, for sealingly connecting to the air intake port of the electrical drafting fan assembly.

3. The steam/vacuum cleaning apparatus of claim 2, wherein the electrical steam generator further comprises a steam control valve disposed between the boiler and the steam tube, for controlling the steam flowing from the boiler to the steam tube, the steam control valve being operated by a steam injection push button pivotally disposed on the head case housing.

4. A steam/vacuum cleaning apparatus of claim 2, wherein the external connecting member is a steam-air hose set assembly comprising an outer duct, an inner duct, a second male connector and a female connector; wherein the inner and outer ducts are flexible and co-axially arranged; the second male connector being identical with the first male connector and provided at one end of the inner and outer ducts to be received within the U-channel connector of the air/water separating device; the second male connector provided with a suction hole and a steam connector respectively in fluid communication with the air intake duct and the steam nozzle insert of the air/water separating device; the female connector being provided at the other end of the inner and outer hoses and formed with an open connecting head adapted for receiving the second male connector and in fluid communication with the outer duct; a tapered steam connecting head being provided within the female connector for connecting to the second steam connector of the second male connector.

5. The steam/vacuum cleaning apparatus of claim 2, wherein the external connecting member is a steam-air window cleaner assembly comprising a hollow cleaner body, and an inner steam duct, in which the hollow cleaner body includes a first end and a second end and formed therein with a hollow space to serve as an outer duct for directing air to pass therethrough; the small second end formed with as a U-channel a third male connector identical with the first male connector and adapted to be sealingly received within the U-channel connector of the air/water separating device; the third male connector further provided with a suction opening and a third steam connector for respectively engaging and in fluid communication with the air intake duct and the steam nozzle insert of the air/water separating device; the big first end of the cleaner body formed with an elongate slit in fluid communication with the interior of the hollow cleaner body; the elongate slit provided at its one elongate edge a rubber scraper blade for wiping and scrapping a flat and smooth surface to be cleaned; the inner steam duct disposed within the hollow cleaner body and having a steam inlet and a plurality of steam outlets, in which the inlet is adapted to engage the third steam connector of the third male connector, and the outlets being arranged along the elongate slit for uniformly distributing and directing steam along the elongate slit.

6. The steam/vacuum cleaning apparatus of claim 2, wherein the external connecting member is a steam injecting element having two ends, in which one is formed as a nozzle, and the other formed with a fourth male connector identical with the first male connector to be sealingly received within the U-channel connector of the air/water separating device; the fourth male connector provided with a fourth steam connector in fluid communication with an inner steam duct disposed within the steam injecting element for directing steam from the boiler to the nozzle.

7. The steam/vacuum cleaning apparatus of claim 1, further comprising a first and a second power switches for respectively controlling the power of the electrical steam generator and the electrical drafting fan assembly.

* * * * *